US010255836B2

(12) United States Patent
Wen et al.

(10) Patent No.: US 10,255,836 B2
(45) Date of Patent: Apr. 9, 2019

(54) AMOLED DISPLAY DEVICE AND DRIVING METHOD THEREOF

(71) Applicant: Shenzhen China Star Optoelectronics Technology Co., Ltd., Shenzhen (CN)

(72) Inventors: Yichien Wen, Shenzhen (CN); Yugang Bao, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 458 days.

(21) Appl. No.: 14/908,126

(22) PCT Filed: Dec. 22, 2015

(86) PCT No.: PCT/CN2015/098154

§ 371 (c)(1),
(2) Date: Jan. 28, 2016

(87) PCT Pub. No.: WO2017/059628

PCT Pub. Date: Apr. 13, 2017

(65) Prior Publication Data

US 2017/0256191 A1 Sep. 7, 2017

(30) Foreign Application Priority Data

Oct. 10, 2015 (CN) ..... 2015 1 0655699

(51) Int. Cl.
*G09G 3/3275* (2016.01)
*G09G 3/20* (2006.01)
(Continued)

(52) U.S. Cl.
CPC ..... *G09G 3/2003* (2013.01); *G09G 3/3225* (2013.01); *G09G 3/3258* (2013.01);
(Continued)

(58) Field of Classification Search
CPC ..... G09G 2300/0426; G09G 3/2003; G09G 3/3258; G09G 2300/0443; G09G 2300/0452; G09G 2300/0673
See application file for complete search history.

(56) References Cited

U.S. PATENT DOCUMENTS 7,379,081 B2 * 5/2008 Park ..... G09G 3/3291 315/169.2
9,508,292 B2 * 11/2016 Xie ..... G09G 3/3225
(Continued)

FOREIGN PATENT DOCUMENTS

CN 104517559 A 4/2015

*Primary Examiner* — Mark Edwards
(74) *Attorney, Agent, or Firm* — Leong C. Lei

(57) ABSTRACT

The invention provides an AMOLED display device and driving method thereof. The AMOLED display device comprises: a driving circuit (10) and a display panel (20) connected to the driving circuit (10); the display panel (20) comprising a plurality of sub-pixels arranged in an array form, and the sub-pixels further comprising red sub-pixels (R), green sub-pixels (G), blue sub-pixels (B), and white sub-pixels (W); the driving circuit (10) inputting a Gamma control signal (Gamma_change), and outputting a red Gamma voltage curve (Red_Gamma), a green Gamma voltage curve (Green_Gamma), a blue Gamma voltage curve (Blue_Gamma), and a white Gamma voltage curve (White_Gamma); based on different Gamma control signal (Gamma_change), the driving circuit (10) drives the display panel (20) with different sub-pixel arrangements to reduce manufacturing cost, and improve competitiveness.

10 Claims, 9 Drawing Sheets

(51) Int. Cl.
*G09G 3/3258* (2016.01)
*G09G 3/3225* (2016.01)

(52) U.S. Cl.
CPC ... *G09G 3/3275* (2013.01); *G09G 2300/0443* (2013.01); *G09G 2300/0452* (2013.01); *G09G 2320/0673* (2013.01)

(56) References Cited

U.S. PATENT DOCUMENTS

| | | | | |
|---|---|---|---|---|
| 9,570,020 | B2 * | 2/2017 | Yoo | G09G 3/3607 |
| 2008/0117142 | A1 * | 5/2008 | Lin | G09G 3/3225<br>345/76 |
| 2010/0007674 | A1 * | 1/2010 | Lee | G09G 3/3291<br>345/589 |
| 2015/0091952 | A1 * | 4/2015 | Wu | G09G 3/20<br>345/690 |

* cited by examiner

| | 1 | 2 | 3 | 4 | ... | 2m+1 | 2m+2 |
|---|---|---|---|---|---|---|---|
| 1 | Red_Gamma | Blue_Gamma | Red_Gamma | Blue_Gamma | ... | Red_Gamma | Blue_Gamma |
| 2 | Green_Gamma | White_Gamma | Green_Gamma | White_Gamma | ... | Green_Gamma | White_Gamma |
| 3 | Red_Gamma | Blue_Gamma | Red_Gamma | Blue_Gamma | ... | Red_Gamma | Blue_Gamma |
| 4 | Green_Gamma | White_Gamma | Green_Gamma | White_Gamma | ... | Green_Gamma | White_Gamma |
| ⋮ | | ⋮ | | ⋮ | | ⋮ | ⋮ |
| 2n-1 | Red_Gamma | Blue_Gamma | Red_Gamma | Blue_Gamma | ... | Red_Gamma | Blue_Gamma |
| 2n | Green_Gamma | White_Gamma | Green_Gamma | White_Gamma | ... | Green_Gamma | White_Gamma |
| 2n+1 | Red_Gamma | Blue_Gamma | Red_Gamma | Blue_Gamma | ... | Red_Gamma | Blue_Gamma |
| 2n+2 | Green_Gamma | White_Gamma | Green_Gamma | White_Gamma | ... | Green_Gamma | White_Gamma |

Fig. 7

| | 1 | 2 | 3 | 4 | ... | 2m+1 | 2m+2 |
|---|---|---|---|---|---|---|---|
| 1 | Red_Gamma | Blue_Gamma | Red_Gamma | Blue_Gamma | ... | Red_Gamma | Blue_Gamma |
| 2 | Green_Gamma | White_Gamma | Green_Gamma | White_Gamma | ... | Green_Gamma | White_Gamma |
| 3 | Blue_Gamma | Red_Gamma | Blue_Gamma | Red_Gamma | ... | Blue_Gamma | Red_Gamma |
| 4 | White_Gamma | Green_Gamma | White_Gamma | Green_Gamma | ... | White_Gamma | Green_Gamma |
| ⋮ | ⋮ | ⋮ | | ⋮ | | ⋮ | ⋮ |
| 4n+1 | Red_Gamma | Blue_Gamma | Red_Gamma | Blue_Gamma | ... | Red_Gamma | Blue_Gamma |
| 4n+2 | Green_Gamma | White_Gamma | Green_Gamma | White_Gamma | ... | Green_Gamma | White_Gamma |
| 4n+3 | Blue_Gamma | Red_Gamma | Blue_Gamma | Red_Gamma | ... | Blue_Gamma | Red_Gamma |
| 4n+4 | White_Gamma | Green_Gamma | White_Gamma | Green_Gamma | ... | White_Gamma | Green_Gamma |

Fig. 9

AMOLED DISPLAY DEVICE AND DRIVING METHOD THEREOF

BACKGROUND OF THE INVENTION

1. Field of the Invention

The present invention relates to the field of display, and in particular to an active matrix organic light emitting diode (OLED) display (AMOLED) device and driving method thereof.

2. The Related Arts

The organic light-emitting diode (OLED) display has the advantages of active light-emitting, low driving voltage, high luminance efficiency, short response time, high clarity and contrast, near 180°, large working temperature range, and ability to realize flexible display and large-area full-color display, and therefore is common considered as the most promising display.

Based on the driving method, OLED display can be categorized as passive matrix OLED display (PMOLED), or active matrix OLED display (AMOLED); that is, the direct addressing and thin film transistor (TFT) addressing, wherein the AMOLED display panel is thin, light-weighted, active light-emitting, quick response, wide viewing angle, rich color, high luminance, low energy-consumption, and is often considered as the third generation display technology after the liquid crystal display (LCD). AMOLED can be used to realize large-size, high-definition panel, and is the future of the display technology.

In the known OLED display device, a pixel comprises a red sub-pixel R, a green sub-pixel G and a blue sub-pixel B. As the user demands grow, a four-color display panel is developed. In the four-color display panel, a pixel comprises a red sub-pixel, a green sub-pixel, a blue sub-pixel and a white sub-pixel. Compared to the conventional three-color display panel, the additional white sub-pixel can improve the opening ratio and the color expressiveness of the display panel. As shown in FIG. 1, each pixel comprises a red sub-pixel R, a green sub-pixel G, a blue sub-pixel B, and a white sub-pixel W. The sub-pixels are arranged in an array form, wherein each column of sub-pixels has the same layout order as the adjacent column of sub-pixels, and the sub-pixels in each row are of the same color. Each row of sub-pixels inputs a Gamma curve of corresponding color. In other words, the first row of sub-pixels uses red Gamma curve Red_Gamma, the second row of sub-pixels uses green Gamma curve Green_Gamma, the third row of sub-pixels uses blue Gamma curve Blue_Gamma, and the fourth row of sub-pixels uses white Gamma curve White_Gamma. As such, the layout structure of the pixels is simpler, but not necessary provides the optimal display effect.

As the technology progresses, as shown in FIG. 2 and FIG. 3, a pixel structure of interleaved form arrangement is developed. In the interleaved form arrangement, the vertically adjacent two sub-pixels in the same row of pixel are of different color; therefore, the conventional Gamma curve input cannot be used to drive the display panel.

SUMMARY OF THE INVENTION

The object of the present invention is to provide an AMOLED display device, suitable for various display devices with different sub-pixel arrangement to reduce manufacturing cost and improve competitiveness.

Another object of the present invention is to provide a driving method for AMOLED, suitable for various display devices with different sub-pixel arrangement to reduce manufacturing cost and improve competitiveness.

To achieve the above object, the present invention provides an AMOLED display device, which comprises:

a driving circuit, and a display panel connected to the driving circuit;

the display panel comprises: a plurality of sub-pixels arranged in an array form, the sub-pixels further comprising: red sub-pixels, green sub-pixels, blue sub-pixels, and white sub-pixels;

the driving circuit inputting Gamma control signals, and outputting a red Gamma voltage curve, a green Gamma voltage curve, a blue Gamma voltage curve, and a white Gamma voltage curve; and, based on different Gamma control signals, the driving circuit driving the display panel with different sub-pixel arrangement.

Each column of sub-pixels is arranged in the order of red sub-pixel, followed by green sub-pixel, followed by blue sub-pixel, followed by white sub-pixel, and so on;

the Gamma control signal is 0, for a natural number n, the driving circuit inputs the red Gamma voltage curve, green Gamma voltage curve, blue Gamma voltage curve and white Gamma voltage curve to the (4n+1)-th, (4n+2)-th, (4n+3)-th and (4n+4)-th rows of sub-pixels respectively.

Each odd-numbered column of sub-pixels is arranged in the order of interleaved red sub-pixel and green sub-pixel, and each even-numbered column of sub-pixels is arranged in the order of interleaved blue sub-pixel and white sub-pixel;

the Gamma control signal is 1, for natural numbers n and m, the driving circuit inputs the red Gamma voltage curve, green Gamma voltage curve, blue Gamma voltage curve and white Gamma voltage curve to the (2n+1)-th row (2m+1)-th column of sub-pixels, (2n+2)-th row (2m+1)-th column of sub-pixels, (2n+1)-th row (2m+2)-th column of sub-pixels, and (2n+2)-th row (2m+2)-th column of sub-pixels, respectively.

Each odd-numbered column of sub-pixels is arranged in the order of red sub-pixel, followed by green sub-pixel, followed by blue sub-pixel, followed by white sub-pixel, and so on, and each even-numbered column of sub-pixels is arranged in the order of blue sub-pixel, followed by white sub-pixel, followed by red sub-pixel, followed by green sub-pixel, and so on;

the Gamma control signal is 2, for natural numbers n and m, the driving circuit inputs the red Gamma voltage curve, green Gamma voltage curve, blue Gamma voltage curve and white Gamma voltage curve to the (2m+1)-th column (4n+1)-th row of sub-pixels, (2m+1)-th column (4n+2)-th row of sub-pixels, (2m+1)-th column (4n+3)-th row of sub-pixels, (2m+1)-th column and (4n+4)-th row of sub-pixels, respectively, and inputs the blue Gamma voltage curve, white Gamma voltage curve, red Gamma voltage curve, and green Gamma voltage curve, to the (2m+2)-th column (4n+1)-th row of sub-pixels, (2m+2)-th column (4n+2)-th row of sub-pixels, (2m+2)-th column (4n+3)-th row of sub-pixels, (2m+2)-th column and (4n+4)-th row of sub-pixels, respectively.

The driving circuit also imports a plurality of red Gamma reference voltages, green Gamma reference voltages, blue Gamma reference voltages and white Gamma reference voltages for generating the red Gamma voltage curve, green Gamma voltage, blue Gamma voltage curve and white Gamma voltage curve.

The present invention also provides a driving method for an AMOLED display device, which comprises:

Step 1: providing an AMOLED display device, the AMOLED display device having a driving circuit and a display panel connected to the driving circuit;

the display panel comprising a plurality of sub-pixels arranged in an array form, and the sub-pixels further comprising red sub-pixels, green sub-pixels, blue sub-pixels, and white sub-pixels;

the driving circuit inputting Gamma control signals, and outputting a red Gamma voltage curve, a green Gamma voltage curve, a blue Gamma voltage curve, and a white Gamma voltage curve;

Step 2: based on different arrangement of the sub-pixels in the display panel, different Gamma control signal is inputted to the driving circuit; and Step 3: based on different Gamma control signals inputted to the driving circuit, the driving circuit outputting corresponding Gamma curves to drive the display panel to accomplish displaying.

In Step 2, each column of sub-pixels is arranged in the order of red sub-pixel, followed by green sub-pixel, followed by blue sub-pixel, followed by white sub-pixel, and so on; the Gamma control signal is 0; and in Step 3, for a natural number n, the driving circuit inputs the red Gamma voltage curve, green Gamma voltage curve, blue Gamma voltage curve and white Gamma voltage curve to the (4n+1)-th, (4n+2)-th, (4n+3)-th and (4n+4)-th rows of sub-pixels respectively.

In Step 2, each odd-numbered column of sub-pixels is arranged in the order of interleaved red sub-pixel and green sub-pixel, and each even-numbered column of sub-pixels is arranged in the order of interleaved blue sub-pixel and white sub-pixel; the Gamma control signal is 1; and in Step 3, for natural numbers n and m, the driving circuit inputs the red Gamma voltage curve, green Gamma voltage curve, blue Gamma voltage curve and white Gamma voltage curve to the (2n+1)-th row (2m+1)-th column of sub-pixels, (2n+2)-th row (2m+1)-th column of sub-pixels, (2n+1)-th row (2m+2)-th column of sub-pixels, and (2n+2)-th row (2m+2)-th column of sub-pixels, respectively.

In Step 2, each odd-numbered column of sub-pixels is arranged in the order of red sub-pixel, followed by green sub-pixel, followed by blue sub-pixel, followed by white sub-pixel, and so on, and each even-numbered column of sub-pixels is arranged in the order of blue sub-pixel, followed by white sub-pixel, followed by red sub-pixel, followed by green sub-pixel, and so on; the Gamma control signal is 2; and in Step 3, for natural numbers n and m, the driving circuit inputs the red Gamma voltage curve, green Gamma voltage curve, blue Gamma voltage curve and white Gamma voltage curve to the (2m+1)-th column (4n+1)-th row of sub-pixels, (2m+1)-th column (4n+2)-th row of sub-pixels, (2m+1)-th column (4n+3)-th row of sub-pixels, (2m+1)-th column and (4n+4)-th row of sub-pixels, respectively, and inputs the blue Gamma voltage curve, white Gamma voltage curve, red Gamma voltage curve, and green Gamma voltage curve, to the (2m+2)-th column (4n+1)-th row of sub-pixels, (2m+2)-th column (4n+2)-th row of sub-pixels, (2m+2)-th column (4n+3)-th row of sub-pixels, (2m+2)-th column and (4n+4)-th row of sub-pixels, respectively.

In Step 3, the driving circuit also imports a plurality of red Gamma reference voltages, green Gamma reference voltages, blue Gamma reference voltages and white Gamma reference voltages for generating the red Gamma voltage curve, green Gamma voltage, blue Gamma voltage curve and white Gamma voltage curve.

The present invention also provides a driving method for an AMOLED display device, which comprises the steps of:

Step 1: providing an AMOLED display device, the AMOLED display device having a driving circuit and a display panel connected to the driving circuit;

the display panel comprising a plurality of sub-pixels arranged in an array form, and the sub-pixels further comprising red sub-pixels, green sub-pixels, blue sub-pixels, and white sub-pixels;

the driving circuit inputting Gamma control signals, and outputting a red Gamma voltage curve, a green Gamma voltage curve, a blue Gamma voltage curve, and a white Gamma voltage curve;

Step 2: based on different arrangement of the sub-pixels in the display panel, a different Gamma control signal is inputted to the driving circuit; and Step 3: based on different Gamma control signals inputted to the driving circuit, the driving circuit outputting corresponding Gamma curves to drive the display panel to accomplish displaying;

wherein in Step 2, each column of sub-pixels is arranged in the order of red sub-pixel, followed by green sub-pixel, followed by blue sub-pixel, followed by white sub-pixel, and so on; the Gamma control signal is 0; and in Step 3, for a natural number n, the driving circuit inputs the red Gamma voltage curve, green Gamma voltage curve, blue Gamma voltage curve and white Gamma voltage curve to the (4n+1)-th, (4n+2)-th, (4n+3)-th and (4n+4)-th rows of sub-pixels respectively; and in Step 3, the driving circuit also imports a plurality of red Gamma reference voltages, green Gamma reference voltages, blue Gamma reference voltages and white Gamma reference voltages for generating the red Gamma voltage curve, green Gamma voltage, blue Gamma voltage curve and white Gamma voltage curve.

Compared to the known techniques, the present invention provides the following advantages: the present invention provides an AMOLED display device, by using a Gamma control signal to control the output of Gamma curve, and based on the arrangement of the sub-pixels in the display panel to select the Gamma control signal so that different Gamma control signal corresponds to outputting different Gamma curve, to drive display panels with different sub-pixels arrangements as well as reduce manufacturing cost, and improve competitiveness. The present invention also provides a driving method of AMOLED display device, able to drive various display panels with different sub-pixel arrangements to reduce manufacturing cost and improve competitiveness.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings:

FIG. 7 is a schematic view showing the Gamma curve output for the second embodiment of an AMOLED display device provided by an embodiment of the present invention;

FIG. 9 is a schematic view showing the Gamma curve output for the third embodiment of an AMOLED display device provided by an embodiment of the present invention.

DETAILED DESCRIPTION OF THE PREFERRED EMBODIMENTS

To further explain the technical means and effect of the present invention, the following refers to embodiments and drawings for detailed description.

Figure 1:
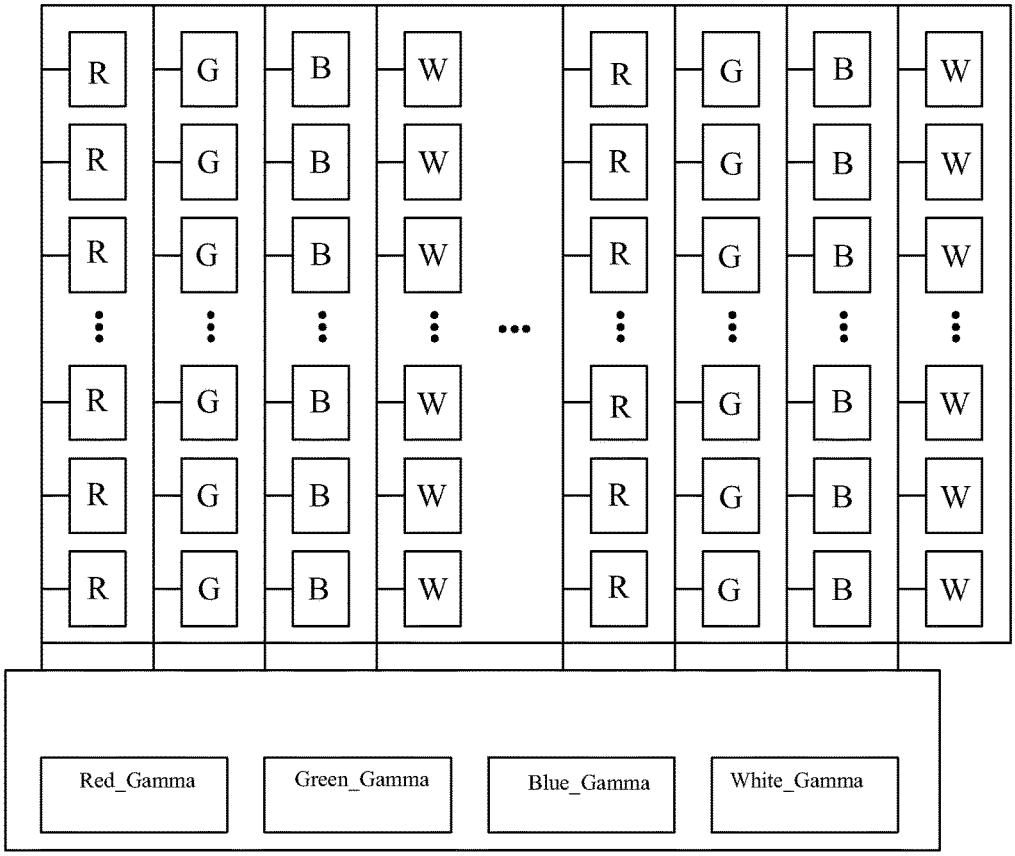
FIG. 1 is a schematic view showing the structure of known AMOLED display device.
Figure 2:
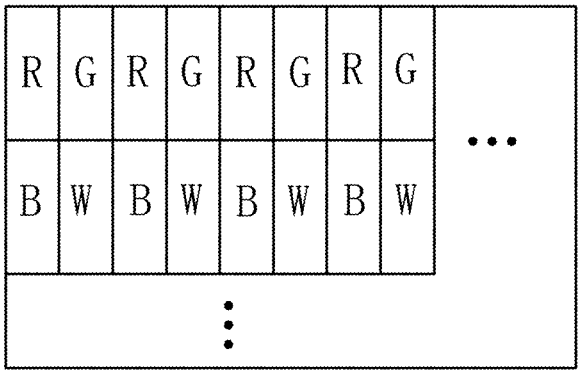
FIGS. 2-3 are schematic views showing interleaved pixel structures of known AMOLED display device.
Figure 3:
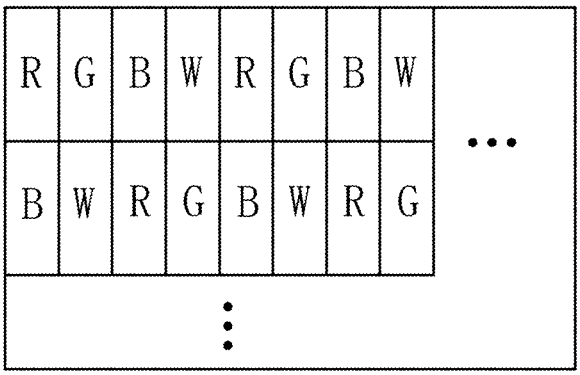
Figure 4:
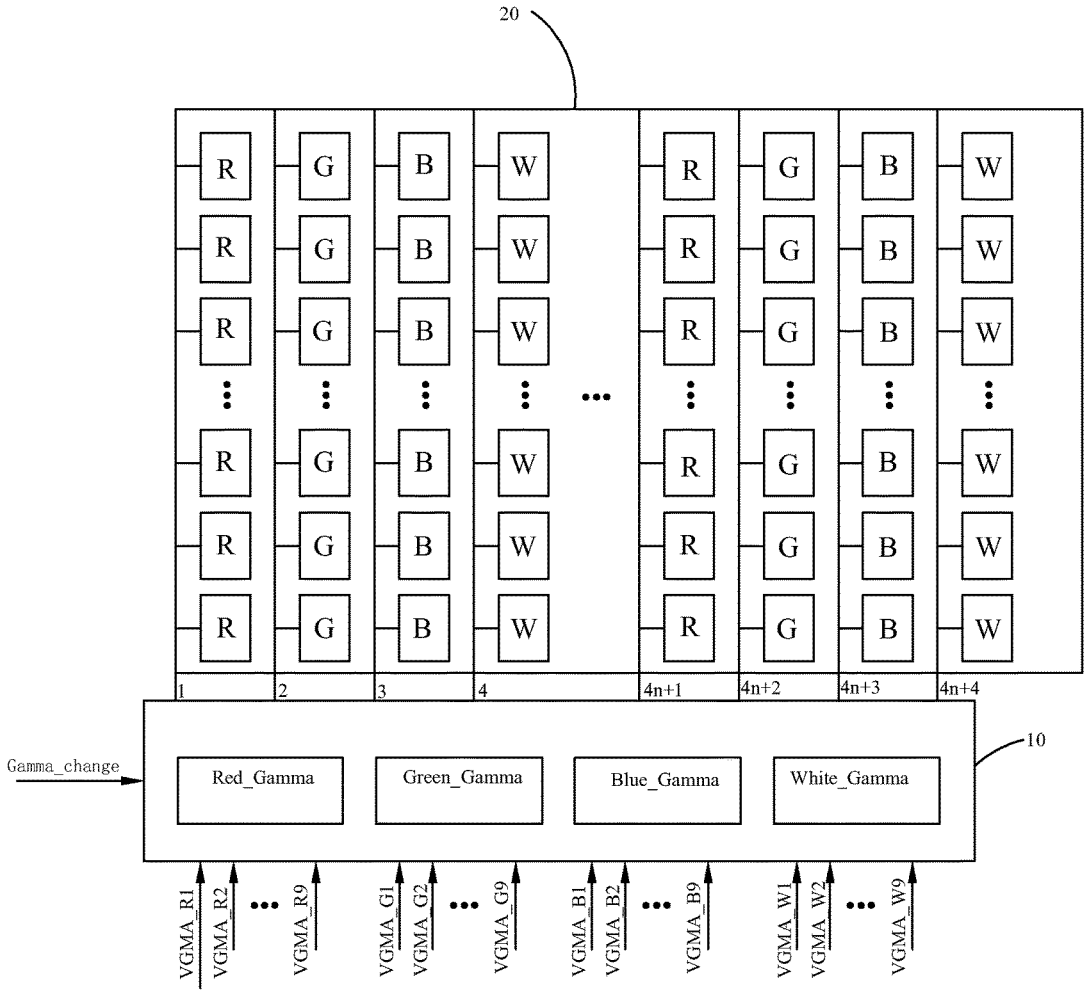
FIG. 4 is a schematic view showing a first embodiment of an AMOLED display device provided by an embodiment of the present invention.
Figure 6:
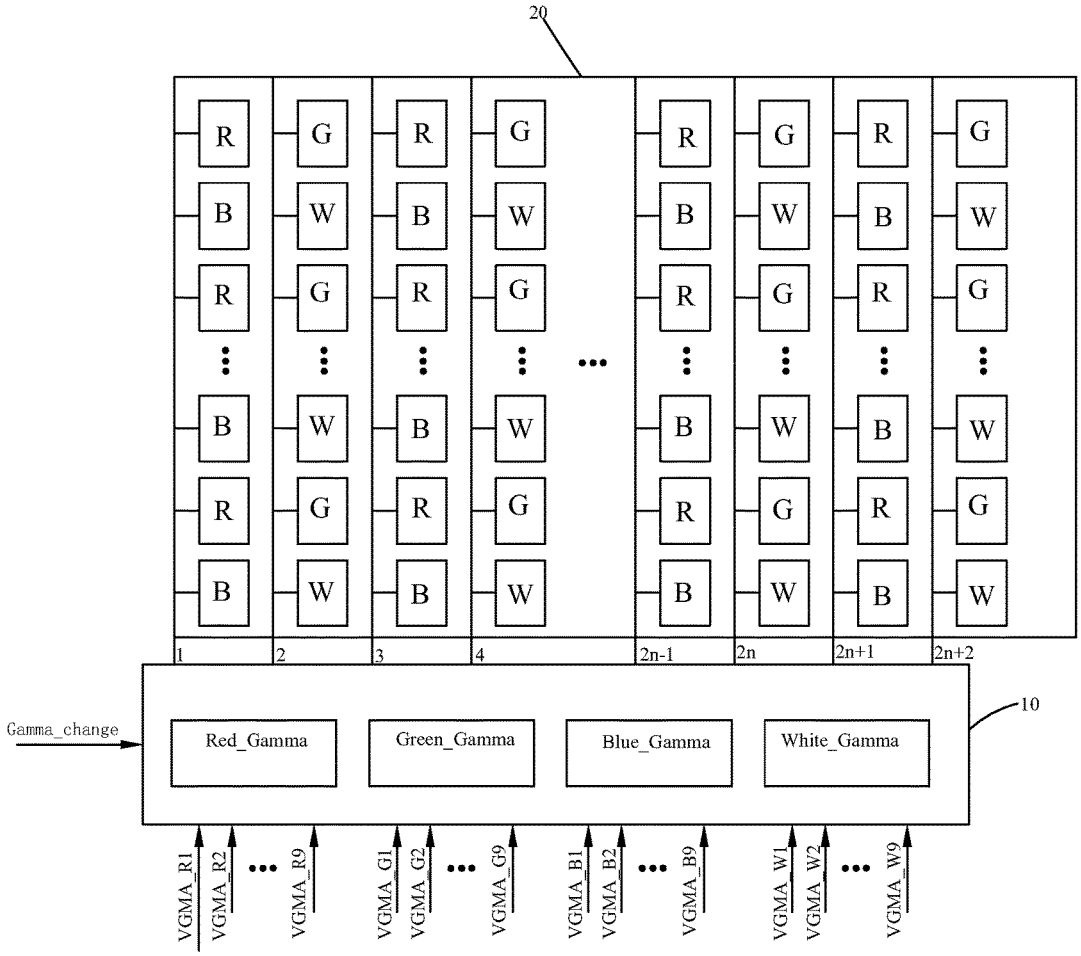
FIG. 6 is a schematic view showing a second embodiment of an AMOLED display device provided by an embodiment of the present invention.
Figure 8:
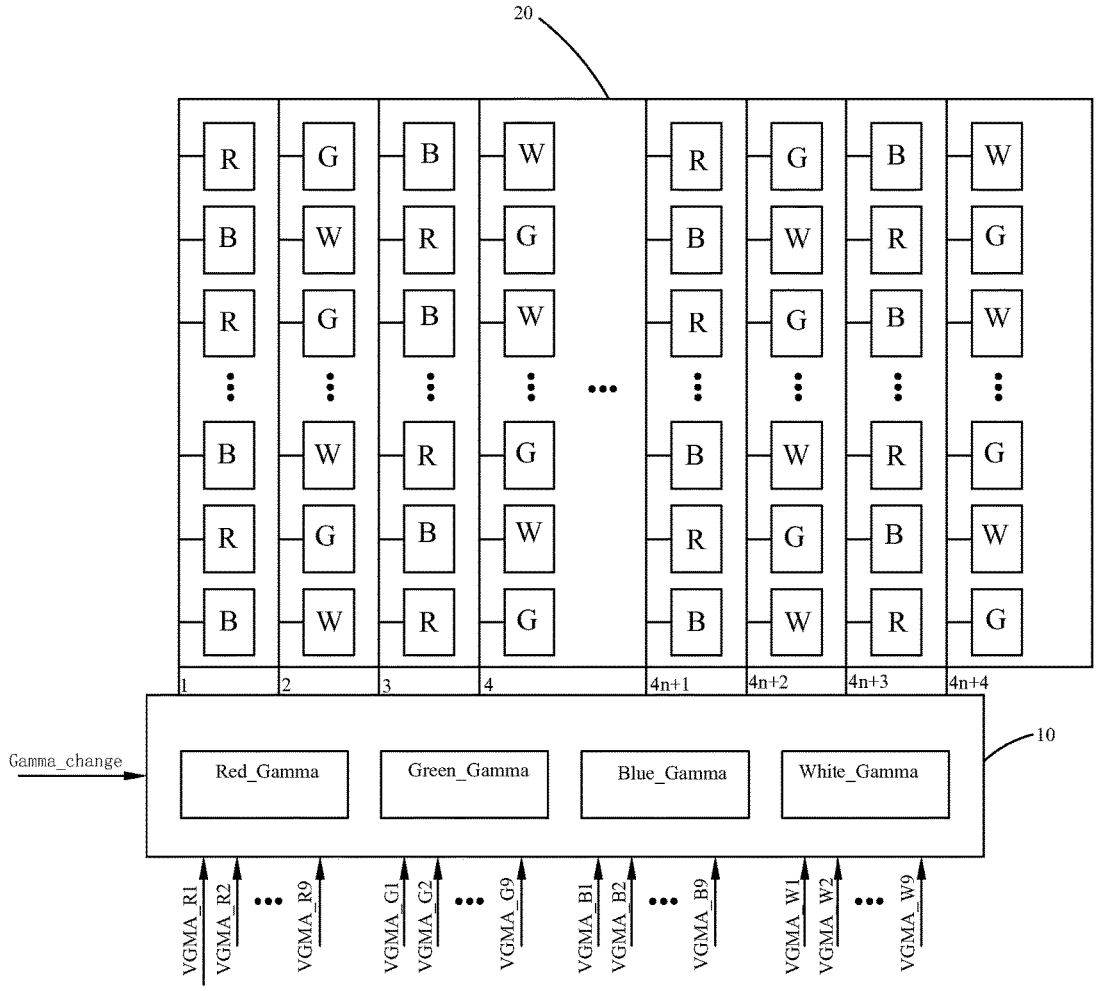
FIG. 8 is a schematic view showing a third embodiment of an AMOLED display device provided by an embodiment of the present invention.

Refer to FIGS. 4, 6 and 8. The present invention provides an AMOLED display device, which comprises:

a driving circuit 10, and a display panel 20 connected to the driving circuit 10;

the display panel 20 comprises: a plurality of sub-pixels arranged in an array form, the sub-pixels further comprising: red sub-pixels R, green sub-pixels G, blue sub-pixels B, and white sub-pixels W;

the driving circuit 10 inputting Gamma a control signal Gamma_change, and outputting a red Gamma voltage curve Red_Gamma, a green Gamma voltage curve Green_Gamma, a blue Gamma voltage curve Blue_Gamma, and a white Gamma voltage curve White_Gamma; and, based on different Gamma control signals, the driving circuit 10 driving the display panel 20 with different sub-pixel arrangement.

Figure 5:
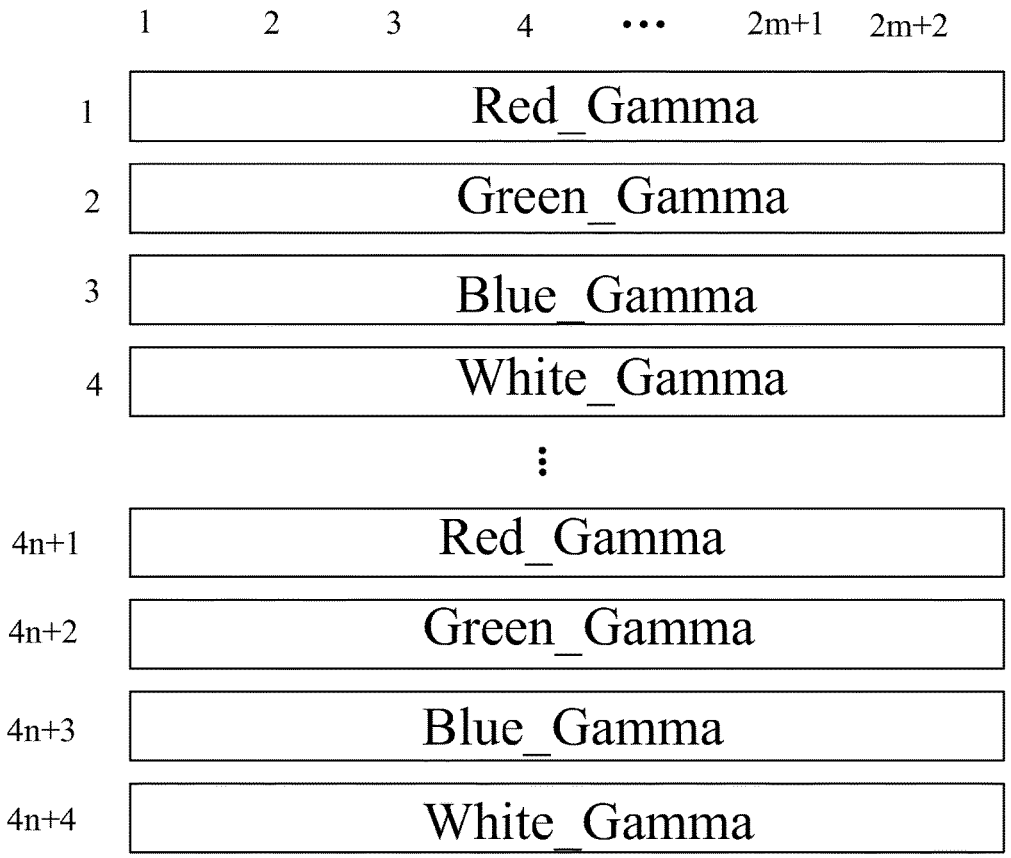
FIG. 5 is a schematic view showing the Gamma curve output for the first embodiment of an AMOLED display device provided by an embodiment of the present invention.

Specifically, the display panel uses four colors for displaying. By using the white sub-pixels to improve the opening ratio and color expressiveness of the display panel, various the sub-pixels arrangements including interleaving sub-pixels of different colors can be adopted. A different Gamma control signal Gamma_change value can be used to correspond to a different sub-pixel arrangement. As a first embodiment of the present invention shown in FIG. 4, the sub-pixel arrangement is as follows: each column of sub-pixels is arranged in the order of red sub-pixel R, followed by green sub-pixel G, followed by blue sub-pixel B, followed by white sub-pixel W, then repeat the above order, and so on; the sub-pixel arrangement in FIG. 4 corresponds to a Gamma control signal Gamma_change=0. Under this condition, the Gamma curve output is as follows: for a natural number n, the driving circuit 10 inputs the red Gamma voltage curve Red_Gamma, green Gamma voltage curve Green_Gamma, blue Gamma voltage curve Blue_Gamma, and white Gamma voltage curve White_Gamma to the (4n+1)-th, (4n+2)-th, (4n+3)-th and (4n+4)-th rows of sub-pixels, respectively. As shown in FIG. 5, regardless of scanning an odd-numbered column or an even-numbered column, in each scanning, the driving circuit 10 inputs the red Gamma voltage curve Red_Gamma, green Gamma voltage curve Green_Gamma, blue Gamma voltage curve Blue_Gamma, and white Gamma voltage curve White_Gamma to the (4n+1)-th, (4n+2)-th, (4n+3)-th and (4n+4)-th rows of sub-pixels, respectively.

The AMOLED display device of the present invention may also arrange the sub-pixels in an interleaving manner. As the second embodiment shown in FIG. 6, each odd-numbered column of sub-pixels is arranged in the order of interleaved red sub-pixel R and green sub-pixel G, then repeat the above order, and each even-numbered column of sub-pixels is arranged in the order of interleaved blue sub-pixel B and white sub-pixel W, then repeat the above order. The sub-pixel arrangement in FIG. 6 corresponds to a Gamma control signal Gamma_change=1. Under this condition, the Gamma curve output is as follows: for natural numbers n and m, the driving circuit 10 inputs the red Gamma voltage curve Red_Gamma, green Gamma voltage curve Green_Gamma, blue Gamma voltage curve Blue_Gamma, and white Gamma voltage curve White_Gamma to the (2n+1)-th row (2m+1)-th column of sub-pixels, (2n+2)-th row (2m+1)-th column of sub-pixels, (2n+1)-th row (2m+2)-th column of sub-pixels, and (2n+2)-th row (2m+2)-th column of sub-pixels, respectively. Refer to FIG. 7, when scanning the odd-numbered columns or even-numbered columns of the display panel, different Gamma curves are inputted, wherein when scanning odd-numbered columns, the driving circuit 10 inputs the red Gamma voltage curve Red_Gamma and green Gamma voltage curve Green_Gamma, to the (2n+1)-th row and (2n+2)-th row of sub-pixels of the currently scanned column; when scanning even_numbered columns, the driving circuit 10 inputs the blue Gamma voltage curve Blue_Gamma and white Gamma voltage curve White_Gamma to (2n+1)-th row and (2n+2)-th row of sub-pixels of the currently scanned column.

Refer to FIG. 8 for the third embodiment of the present invention, wherein each odd-numbered column of sub-pixels is arranged in the order of red sub-pixel R, followed by green sub-pixel G, followed by blue sub-pixel B, followed by white sub-pixel W, then repeat the above order, and so on, and each even-numbered column of sub-pixels is arranged in the order of blue sub-pixel B, followed by white sub-pixel W, followed by red sub-pixel R, followed by green sub-pixel G, then repeat the above order, and so on; the corresponding selected Gamma control signal Gamma_change=2. For natural numbers n and m, the driving circuit 10 inputs the red Gamma voltage curve Red_Gamma, green Gamma voltage curve Green_Gamma, blue Gamma voltage curve Blue_Gamma, and white Gamma voltage curve White_Gamma to the (2m+1)-th column (4n+1)-th row of sub-pixels, (2m+1)-th column (4n+2)-th row of sub-pixels, (2m+1)-th column (4n+3)-th row of sub-pixels, (2m+1)-th column and (4n+4)-th row of sub-pixels, respectively, and inputs the blue Gamma voltage curve Blue_Gamma, white Gamma voltage curve White_Gamma, red Gamma voltage curve Red_Gamma, and green Gamma voltage curve Green_Gamma, to the (2m+2)-th column (4n+1)-th row of sub-pixels, (2m+2)-th column (4n+2)-th row of sub-pixels, (2m+2)-th column (4n+3)-th row of sub-pixels, (2m+2)-th column and (4n+4)-th row of sub-pixels, respectively. Refer to FIG. 9, when scanning the odd-numbered columns or even-numbered columns of the display panel, different Gamma curves are inputted, wherein when scanning odd-numbered columns, the driving circuit 10 inputs the red Gamma voltage curve Red_Gamma, green Gamma voltage curve Green_Gamma, blue Gamma voltage curve Blue_Gamma, and white Gamma voltage curve White_Gamma to the (4n+1)-th row, (4n+2)-th row, (4n+3)-th row, and (4n+4)-th row of sub-pixels of the currently scanned column; when scanning even_numbered columns, the driving circuit 10 inputs the blue Gamma voltage curve Blue_Gamma and white Gamma voltage curve White_Gamma, red Gamma voltage curve Red_Gamma, and green Gamma voltage curve Green_Gamma to the (4n+1)-th row, (4n+2)-th row, (4n+3)-th row, and (4n+4)-th row sub-pixels of the currently scanned column.

Moreover, the driving circuit 10 also imports a plurality of red Gamma reference voltages (such as, VGMA_R1, VGMA_R1, . . . , VGMA_R9), green Gamma reference voltages (such as, VGMA_G1, VGMA_G1, . . . , VGMA_G9), blue Gamma reference voltages (such as, VGMA_B1, VGMA_B1, . . . , VGMA_B9), and white Gamma reference voltages (such as, VGMA_W1, VGMA_W1, . . . , VGMA_W9) for generating the red Gamma voltage curve Red_Gamma, green Gamma voltage curve Green_Gamma, blue Gamma voltage curve Blue_Gamma, and white Gamma voltage curve White_Gamma, respectively.

Figure 10:
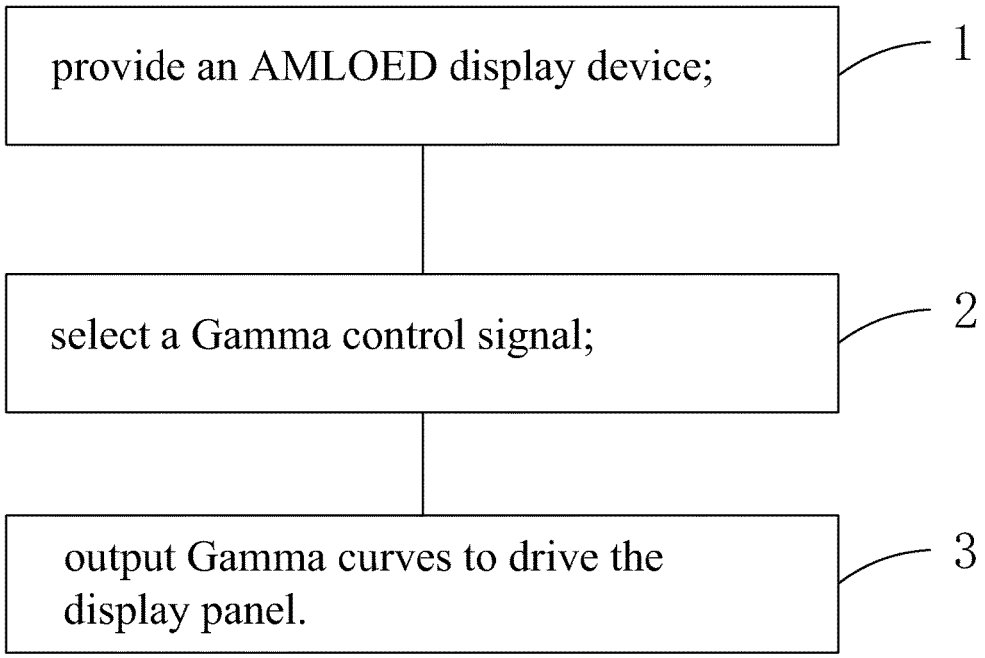
FIG. 10 is a schematic view showing the flowchart of the driving method of the AMOLED display device provided by an embodiment of the present invention.

Refer to FIG. 10. The present invention also provides a driving method for an AMOLED display device, which comprises the steps of:

Step 1: providing an AMOLED display device, the AMOLED display device having a driving circuit 10 and a display panel 20 connected to the driving circuit 10;

the display panel 20 comprising a plurality of sub-pixels arranged in an array form, and the sub-pixels further comprising red sub-pixels R, green sub-pixels G, blue sub-pixels B, and white sub-pixels W;

the driving circuit 10 inputting a Gamma control signal Gamma_change, and outputting a red Gamma voltage curve Red_Gamma, a green Gamma voltage curve Green_Gamma, a blue Gamma voltage curve Blue_Gamma, and a white Gamma voltage curve White_Gamma;

Step 2: based on different arrangement of the sub-pixels in the display panel 20, a different Gamma control signal Gamma_change is inputted to the driving circuit 10;

Specifically, the display panel uses four colors for displaying. By using the white sub-pixels to improve the opening ratio and color expressiveness of the display panel, various the sub-pixels arrangements including interleaving sub-pixels of different colors can be adopted. A different Gamma control signal Gamma_change value can be used to correspond to a different sub-pixel arrangement.

As the first embodiment of the present invention shown in FIG. 4, the sub-pixel arrangement is as follows: each column of sub-pixels is arranged in the order of red sub-pixel R, followed by green sub-pixel G, followed by blue sub-pixel B, followed by white sub-pixel W, then repeat the above order, and so on. The sub-pixel arrangement in FIG. 4 corresponds to a Gamma control signal Gamma_change=0.

As the second embodiment shown in FIG. 6, each odd-numbered column of sub-pixels is arranged in the order of interleaved red sub-pixel R and green sub-pixel G, then repeat the above order, and each even-numbered column of sub-pixels is arranged in the order of interleaved blue sub-pixel B and white sub-pixel W, then repeat the above order. The sub-pixel arrangement in FIG. 6 corresponds to a Gamma control signal Gamma_change=1.

Refer to FIG. 8 for the third embodiment of the present invention, wherein each odd-numbered column of sub-pixels is arranged in the order of red sub-pixel R, followed by green sub-pixel G, followed by blue sub-pixel B, followed by white sub-pixel W, then repeat the above order, and so on, and each even-numbered column of sub-pixels is arranged in the order of blue sub-pixel B, followed by white sub-pixel W, followed by red sub-pixel R, followed by green sub-pixel G, then repeat the above order, and so on; the corresponding selected Gamma control signal Gamma_change=2.

Step 3: based on the different Gamma control signal Gamma_change inputted to the driving circuit 10, the driving circuit 10 outputting corresponding Gamma curves to drive the display panel 20 to accomplish displaying.

Specifically, when the Gamma control signal Gamma_change=0. Under this condition, the Gamma curve output is as follows: for a natural number n, the driving circuit 10 inputs the red Gamma voltage curve Red_Gamma, green Gamma voltage curve Green_Gamma, blue Gamma voltage curve Blue_Gamma, and white Gamma voltage curve White_Gamma to the (4n+1)-th, (4n+2)-th, (4n+3)-th and (4n+4)-th rows of sub-pixels, respectively. As shown in FIG. 5, regardless of scanning an odd-numbered column or an even-numbered column, in each scanning, the driving circuit 10 inputs the red Gamma voltage curve Red_Gamma, green Gamma voltage curve Green_Gamma, blue Gamma voltage curve Blue_Gamma, and white Gamma voltage curve White_Gamma to the (4n+1)-th, (4n+2)-th, (4n+3)-th and (4n+4)-th rows of sub-pixels, respectively.

When the Gamma control signal Gamma_change=1. Under this condition, the Gamma curve output is as follows: for natural numbers n and m, the driving circuit 10 inputs the red Gamma voltage curve Red_Gamma, green Gamma voltage curve Green_Gamma, blue Gamma voltage curve Blue_Gamma, and white Gamma voltage curve White_Gamma to the (2n+1)-th row (2m+1)-th column of sub-pixels, (2n+2)-th row (2m+1)-th column of sub-pixels, (2n+1)-th row (2m+2)-th column of sub-pixels, and (2n+2)-th row (2m+2)-th column of sub-pixels, respectively. Refer to FIG. 7, when scanning the odd-numbered columns or even-numbered columns of the display panel, different Gamma curves are inputted, wherein when scanning odd-numbered columns, the driving circuit 10 inputs the red Gamma voltage curve Red_Gamma and green Gamma voltage curve Green_Gamma, to the (2n+1)-th row and (2n+2)-th row of sub-pixels of the currently scanned column; when scanning even_numbered columns, the driving circuit 10 inputs the blue Gamma voltage curve Blue_Gamma and white Gamma voltage curve White_Gamma to (2n+1)-th row and (2n+2)-th row of sub-pixels of the currently scanned column.

When the Gamma control signal Gamma_change=2, for natural numbers n and m, the driving circuit 10 inputs the red Gamma voltage curve Red_Gamma, green Gamma voltage curve Green_Gamma, blue Gamma voltage curve Blue_Gamma, and white Gamma voltage curve White_Gamma to the (2m+1)-th column (4n+1)-th row of sub-pixels, (2m+1)-th column (4n+2)-th row of sub-pixels, (2m+1)-th column (4n+3)-th row of sub-pixels, (2m+1)-th column and (4n+4)-th row of sub-pixels, respectively, and inputs the blue Gamma voltage curve Blue_Gamma, white Gamma voltage curve White_Gamma, red Gamma voltage curve Red_Gamma, and green Gamma voltage curve Green_Gamma, to the (2m+2)-th column (4n+1)-th row of sub-pixels, (2m+2)-th column (4n+2)-th row of sub-pixels, (2m+2)-th column (4n+3)-th row of sub-pixels, (2m+2)-th column and (4n+4)-th row of sub-pixels, respectively. Refer to FIG. 9, when scanning the odd-numbered columns or even-numbered columns of the display panel, different Gamma curves are inputted, wherein when scanning odd-numbered columns, the driving circuit 10 inputs the red Gamma voltage curve Red_Gamma, green Gamma voltage curve Green_Gamma, blue Gamma voltage curve Blue_Gamma, and white Gamma voltage curve White_Gamma to the (4n+1)-th row, (4n+2)-th row, (4n+3)-th row, and (4n+4)-th row of sub-pixels of the currently scanned column; when scanning even_numbered columns, the driving circuit 10 inputs the blue Gamma voltage curve Blue_Gamma and white Gamma voltage curve White_Gamma, red Gamma voltage curve Red_Gamma, and green Gamma voltage curve Green_Gamma to the (4n+1)-th row, (4n+2)-th row, (4n+3)-th row, and (4n+4)-th row sub-pixels of the currently scanned column.

In summary, the present invention provides an AMOLED display device, by using a Gamma control signal to control the output of Gamma curve, and based on the arrangement of the sub-pixels in the display panel to select the Gamma control signal so that different Gamma control signal corresponds to outputting different Gamma curve, to drive display panels with different sub-pixels arrangements as well as reduce manufacturing cost, and improve competitiveness. The present invention also provides a driving method of AMOLED display device, able to drive various display panels with different sub-pixel arrangements to reduce manufacturing cost and improve competitiveness.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. An active matrix organic light-emitting diode (AMOLED) display device, which comprises:

a driving circuit, and a display panel connected to the driving circuit; wherein:

the display panel comprising: a plurality of sub-pixels arranged in an array, the sub-pixels further comprising: red sub-pixels, green sub-pixels, blue sub-pixels, and white sub-pixels;

the driving circuit inputting Gamma control signals, and outputting a red Gamma voltage curve, a green Gamma voltage curve, a blue Gamma voltage curve, and a white Gamma voltage curve; and based on different Gamma control signals, the driving circuit driving the display panel with different sub-pixel arrangement; and wherein the Gamma control signals comprise at least a first Gamma control signal and a second Gamma control signal that are different from each other and respectively control the driving circuit to output the red Gamma voltage curve, the green Gamma voltage curve, the blue Gamma voltage curve, and the white Gamma voltage curve to the red, green, blue, and white sub-pixels of a first arrangement pattern and a second arrangement pattern, respectively, wherein the first arrangement pattern of the red, green, blue, and white sub-pixels is different from the second arrangement pattern of the red, green, blue, and white sub-pixels; and wherein the first Gamma control signal controls the driving circuit to output a first group of selected ones of the red, green, blue, and white Gamma voltage curves to each of two adjacent rows of the array of sub-pixels; and the second Gamma control signal controls the driving circuit to output a second group of selected ones of the red, green, blue, and white Gamma voltage curves to a first one of two adjacent rows of the array and to output a third group of selected ones of the red, green, blue, and white Gamma voltage curves to a second one of the two adjacent rows of the array, the second group of selected ones of the red, green, blue, and white Gamma voltage curves being different from the third group, the first group being different from both the second and third groups.

2. The AMOLED display device as claimed in claim 1, wherein each column of sub-pixels is arranged in the order of red sub-pixel, followed by green sub-pixel, followed by blue sub-pixel, followed by white sub-pixel, and so on; and the Gamma control signal is 0, for a natural number n, the driving circuit inputs the red Gamma voltage curve, green Gamma voltage curve, blue Gamma voltage curve and white Gamma voltage curve to the (4n+1)-th, (4n+2)-th, (4n+3)-th and (4n+4)-th rows of sub-pixels respectively.

3. The AMOLED display device as claimed in claim 1, wherein each odd-numbered column of sub-pixels is arranged in the order of interleaved red sub-pixel and green sub-pixel, and each even-numbered column of sub-pixels is arranged in the order of interleaved blue sub-pixel and white sub-pixel; and the Gamma control signal is 1, for natural numbers n and in, the driving circuit inputs the red Gamma voltage curve, green Gamma voltage curve, blue Gamma voltage curve and white Gamma voltage curve to the (2n+1)-th row (2m+1)-th column of sub-pixels, (2n+2)-th row (2m+1)-th column of sub-pixels, (2n+1)-th row (2m+2)-th column of sub-pixels, and (2n+2)-th row (2m+2)-th column of sub-pixels, respectively.

4. The AMOLED display device as claimed in claim 1, wherein Each odd-numbered column of sub-pixels is arranged in the order of red sub-pixel, followed by green sub-pixel, followed by blue sub-pixel, followed by white sub-pixel, and so on, and each even-numbered column of sub-pixels is arranged in the order of blue sub-pixel, followed by white sub-pixel, followed by red sub-pixel, followed by green sub-pixel, and so on; and the Gamma control signal is 2, for natural numbers n and in, the driving circuit inputs the red Gamma voltage curve, green Gamma voltage curve, blue Gamma voltage curve and white Gamma voltage curve to the (2m+1)-th column (4n+1)-th row of sub-pixels, (2m+1)-th column (4n+2)-th row of sub-pixels, (2m+1)-th column (4n+3)-th row of sub-pixels, (2m+1)-th column and (4n+4)-th row of sub-pixels, respectively, and inputs the blue Gamma voltage curve, white Gamma voltage curve, red Gamma voltage curve, and green Gamma voltage curve, to the (2m+2)-th column (4n+1)-th row of sub-pixels, (2m+2)-th column (4n+2)-th row of sub-pixels, (2m+2)-th column (4n+3)-th row of sub-pixels, (2m+2)-th column and (4n+4)-th row of sub-pixels, respectively.

5. The AMOLED display device as claimed in claim 1, wherein the driving circuit also imports a plurality of red Gamma reference voltages, green Gamma reference voltages, blue Gamma reference voltages and white Gamma reference voltages for generating the red Gamma voltage curve, green Gamma voltage, blue Gamma voltage curve and white Gamma voltage curve.

6. A driving method of an active matrix organic light-emitting diode (AMOLED) display device, which comprises:

Step 1: providing an AMOLED display device, the AMOLED display device having a driving circuit and a display panel connected to the driving circuit;

the display panel comprising a plurality of sub-pixels arranged in an array, and the sub-pixels further comprising red sub-pixels, green sub-pixels, blue sub-pixels, and white sub-pixels; and the driving circuit inputting Gamma control signals, and outputting a red Gamma voltage curve, a green Gamma voltage curve, a blue Gamma voltage curve, and a white Gamma voltage curve;

Step 2: based on different arrangement of the sub-pixels in the display panel, different Gamma control signal is inputted to the driving circuit; and Step 3: based on different Gamma control signals inputted to the driving circuit, the driving circuit outputting corresponding Gamma curves to drive the display panel to accomplish displaying;

wherein the Gamma control signals comprise at least a first Gamma control signal and a second Gamma control signal that are different from each other and respectively control the driving circuit to output the red Gamma voltage curve, the green Gamma voltage curve, the blue Gamma voltage curve, and the white Gamma voltage curve to the red, green, blue, and white sub-pixels of a first arrangement pattern and a second arrangement pattern, respectively, wherein the first arrangement pattern of the red, green, blue, and white sub-pixels is different from the second arrangement pattern of the red, green, blue, and white sub-pixels; and wherein the first Gamma control signal controls the driving circuit to output a first group of selected ones of the red, green, blue, and white Gamma voltage curves to each of two adjacent rows of the array of sub-pixels; and the second Gamma control signal controls the driving circuit to output a second group of selected ones of the red, green, blue, and white Gamma voltage curves to a first one of two adjacent rows of the array and to output a third group of selected ones of the red, green, blue, and white Gamma voltage curves to a second one of the two adjacent rows of the array, the second group of selected ones of the red, green, blue, and white Gamma voltage curves being different from the third group, the first group being different from both the second and third groups.

7. The driving method of AMOLED display device as claimed in claim 6, wherein:

in Step 2, each column of sub-pixels is arranged in the order of red sub-pixel, followed by green sub-pixel, followed by blue sub-pixel, followed by white sub-pixel, and so on; the Gamma control signal is 0; and in Step 3, for a natural number n, the driving circuit inputs the red Gamma voltage curve, green Gamma voltage curve, blue Gamma voltage curve and white Gamma voltage curve to the (4n+1)-th, (4n+2)-th, (4n+3)-th and (4n+4)-th rows of sub-pixels respectively.

8. The driving method of AMOLED display device as claimed in claim 6, wherein:

in Step 2, each odd-numbered column of sub-pixels is arranged in the order of interleaved red sub-pixel and green sub-pixel, and each even-numbered column of sub-pixels is arranged in the order of interleaved blue sub-pixel and white sub-pixel;

the Gamma control signal is 1; and in Step 3, for natural numbers n and in, the driving circuit inputs the red Gamma voltage curve, green Gamma voltage curve, blue Gamma voltage curve and white Gamma voltage curve to the (2n+1)-th row (2m+1)-th column of sub-pixels, (2n+2)-th row (2m+1)-th column of sub-pixels, (2n+1)-th row (2m+2)-th column of sub-pixels, and (2n+2)-th row (2m+2)-th column of sub-pixels, respectively.

9. The driving method of AMOLED display device as claimed in claim 6, wherein:

in Step 2, each odd-numbered column of sub-pixels is arranged in the order of red sub-pixel, followed by green sub-pixel, followed by blue sub-pixel, followed by white sub-pixel, and so on, and each even-numbered column of sub-pixels is arranged in the order of blue sub-pixel, followed by white sub-pixel, followed by red sub-pixel, followed by green sub-pixel, and so on; the Gamma control signal is 2; and in Step 3, for natural numbers n and in, the driving circuit inputs the red Gamma voltage curve, green Gamma voltage curve, blue Gamma voltage curve and white Gamma voltage curve to the (2m+1)-th column (4n+1)-th row of sub-pixels, (2m+1)-th column (4n+2)-th row of sub-pixels, (2m+1)-th column (4n+3)-th row of sub-pixels, (2m+1)-th column and (4n+4)-th row of sub-pixels, respectively, and inputs the blue Gamma voltage curve, white Gamma voltage curve, red Gamma voltage curve, and green Gamma voltage curve, to the (2m+2)-th column (4n+1)-th row of sub-pixels, (2m+2)-th column (4n+2)-th row of sub-pixels, (2m+2)-th column (4n+3)-th row of sub-pixels, (2m+2)-th column and (4n+4)-th row of sub-pixels, respectively.

10. The driving method of AMOLED display device as claimed in claim 6, wherein in Step 3, the driving circuit imports a plurality of red Gamma reference voltages, green Gamma reference voltages, blue Gamma reference voltages and white Gamma reference voltages for generating the red Gamma voltage curve, green Gamma voltage, blue Gamma voltage curve and white Gamma voltage curve.

* * * * *